United States Patent [19]

Bellows et al.

[11] Patent Number: 4,472,696

[45] Date of Patent: Sep. 18, 1984

[54] CIRCUIT BREAKER

[75] Inventors: Alfred H. Bellows, Wayland; Kyung-Cho Chung, Arlington, both of Mass.

[73] Assignee: GTE Laboratories Incorporated, Waltham, Mass.

[21] Appl. No.: 453,075

[22] Filed: Dec. 27, 1982

[51] Int. Cl.[3] ..... H01H 75/12

[52] U.S. Cl. ..... 335/35; 335/23

[58] Field of Search ..... 335/21, 23, 35, 36, 335/37, 168, 169, 170, 174; 337/70, 75

[56] References Cited

U.S. PATENT DOCUMENTS

| | | | |
|---|---|---|---|
| 2,611,052 | 9/1952 | Platz et al. | 335/35 |
| 2,953,661 | 9/1960 | Hammerly et al. | 335/37 |
| 3,030,470 | 4/1962 | Hargreaves | 335/35 |
| 3,566,318 | 2/1971 | Gelzheiser et al. | 335/23 |
| 3,566,326 | 2/1971 | Middendorf et al. | 337/75 |
| 4,047,134 | 9/1977 | Maier et al. | 335/23 |

*Primary Examiner*—E. A. Goldberg
*Assistant Examiner*—George Andrews
*Attorney, Agent, or Firm*—David M. Keay

[57] ABSTRACT

A circuit breaker having an overload mechanism including a support member mounted in the circuit breaker housing. One end of an elongated bimetallic element is fixed to one end of the support member. An armature element is mounted at one end to the one end of the bimetallic element and its other end has a latching surface engaging a trip arm to hold it in a set position. The support member has a reference surface adjacent to its other end and the trip arm is biased against it. An overload current causes the other end of the bimetallic element to deflect, moving the other end of the armature element with it and disengaging its latching surface from the trip arm. The released trip arm pivots to a tripped position causing the breaker contacts to open. The dimensional relationships between the reference surface and the latching surface determine the tripping characteristics of the circuit breaker.

10 Claims, 3 Drawing Figures

CIRCUIT BREAKER

BACKGROUND OF THE INVENTION

This invention relates to circuit breakers. More particularly, it is concerned with low voltage circuit breakers for controlling low and moderate power electrical circuits.

A circuit breaker for use in controlling electrical circuits typically has a set of contacts, one fixed and one movable, and a toggle, or overcenter mechanism, which is manually operated to close and open the contacts. A circuit breaker also includes an overload mechanism for tripping the circuit breaker and opening the contacts automatically when the electrical current through the circuit breaker exceeds certain predetermined conditions.

Typically circuit breakers of this type include an overcenter spring which is connected between a movable contact carrier carrying the movable contact and a trip arm which is held latched in a set position under normal operating conditions. The contact carrier pivots about a pivot point which is shiftable by means of a manually operated handle to place the pivot point on one side of the overcenter spring whereby the spring causes the contacts to be closed, or to place the pivot point on the other side of the overcenter spring whereby the spring causes the contacts to be open. Under overload conditions a current sensitive mechanism releases the latched trip arm and the overcenter spring moves the trip arm from the set to a tripped position. Movement of the trip arm to the tripped position shifts the position of the overcenter spring with respect to the pivot point and the force of the overcenter spring in this position causes the contacts to open.

Typically the overload mechanism includes a bimetallic element which has one end fixed with respect to the circuit breaker housing. The other end of the bimetallic element engages the trip arm but is free with respect to the housing. Under overload conditions the bimetallic element deflects and the free end moves to release the trip arm which moves from the set to the tripped position thereby opening the contacts. Under very high current conditions, such as during a short circuit, the bimetallic element heats rapidly and deflects almost instantaneously to release the trip arm.

Under overload conditions of relatively small magnitude, however, the bimetallic element is designed to deflect slowly so that the overload mechanism trips only after a substantial time interval which is related to the overload current. Small variations in the dimensions of the breaker components can result in a significant effect on the reaction time of the overload mechanism. These dimensional variations may be due to such factors as differences in coefficients of thermal expansion, wear over the life of the breaker, or external mechanical stresses.

SUMMARY OF THE INVENTION

An improved circuit breaker in accordance with the present invention comprises a housing of insulating material. A fixed contact is mounted in the housing and a movable contact is mounted on a contact carrier. An operating means manually moves the contact carrier to selectively move the movable contact between a closed position and an open position with respect to the fixed contact. A trip arm is pivotally mounted in the housing so as to be movable from a set position to a tripped position. The circuit breaker includes a load terminal and a thermally responsive latching member connected in the circuit between the load terminal and the movable contact. A support member is mounted in the housing. One end of the thermally responsive latching member is fixed to one end of the support member. The thermally responsive latching member has a latching surface adjacent to its other end which engages the trip arm and maintains the trip arm in the set position. The support member has a reference surface adjacent to its other end. Biasing means urges the trip arm against the reference surface when the trip arm is in the set position engaging the latching surface. The thermally responsive latching member bends in response to a predetermined current condition to move the latching surface and disengage the latching surface from the trip arm releasing the trip arm for movement to the tripped position. Movement of the trip arm to the tripped position causes the contacts to open.

Figure 2:
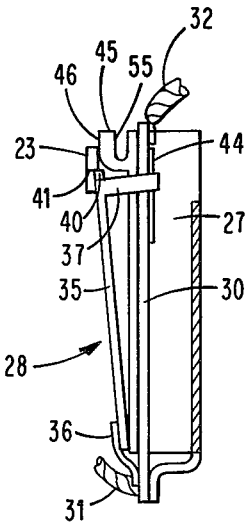
FIG. 2 is an end elevational view of a fragment of the circuit breaker taken generally along line 2—2 of FIG. 1 showing details of the overload mechanism.

For a better understanding of the present invention together with other and further objects, advantages, and capabilities thereof, reference is made to the following discussion and appended claims in connection with the above described drawings.

DETAILED DESCRIPTION INVENTION

A circuit breaker in accordance with the present invention as illustrated in the figures includes a housing comprising a case 10 of a suitable insulating material and a cover (not shown) of similar material. The case and cover are typically of molded plastic. The various elements of the circuit breaker mechanism are mounted within the case 10 and held in place by the cover which is riveted to the case.

A fixed contact 13 is mounted on a line terminal 14 which is designed to engage a line bus when the breaker is inserted into a distribution panel box. A moving contact 15 is mounted on a contact carrier 16. A handle 17 of insulating material is pivotally mounted within the case 10 in a conventional manner for manual operation.

Figure 1:
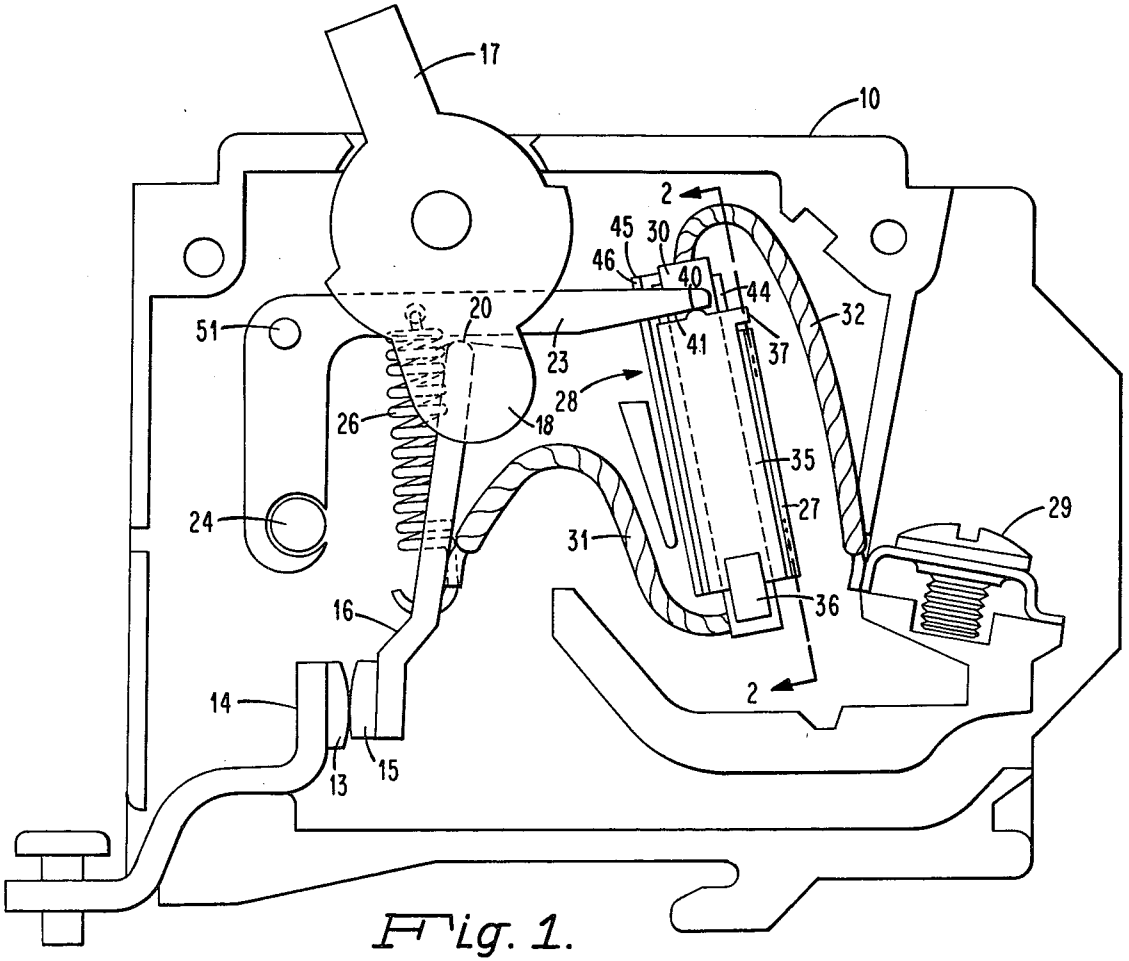
FIG. 1 is a side elevational view of a circuit breaker in accordance with the present invention with the cover of the housing removed and showing the contacts in the closed position.
Figure 3:
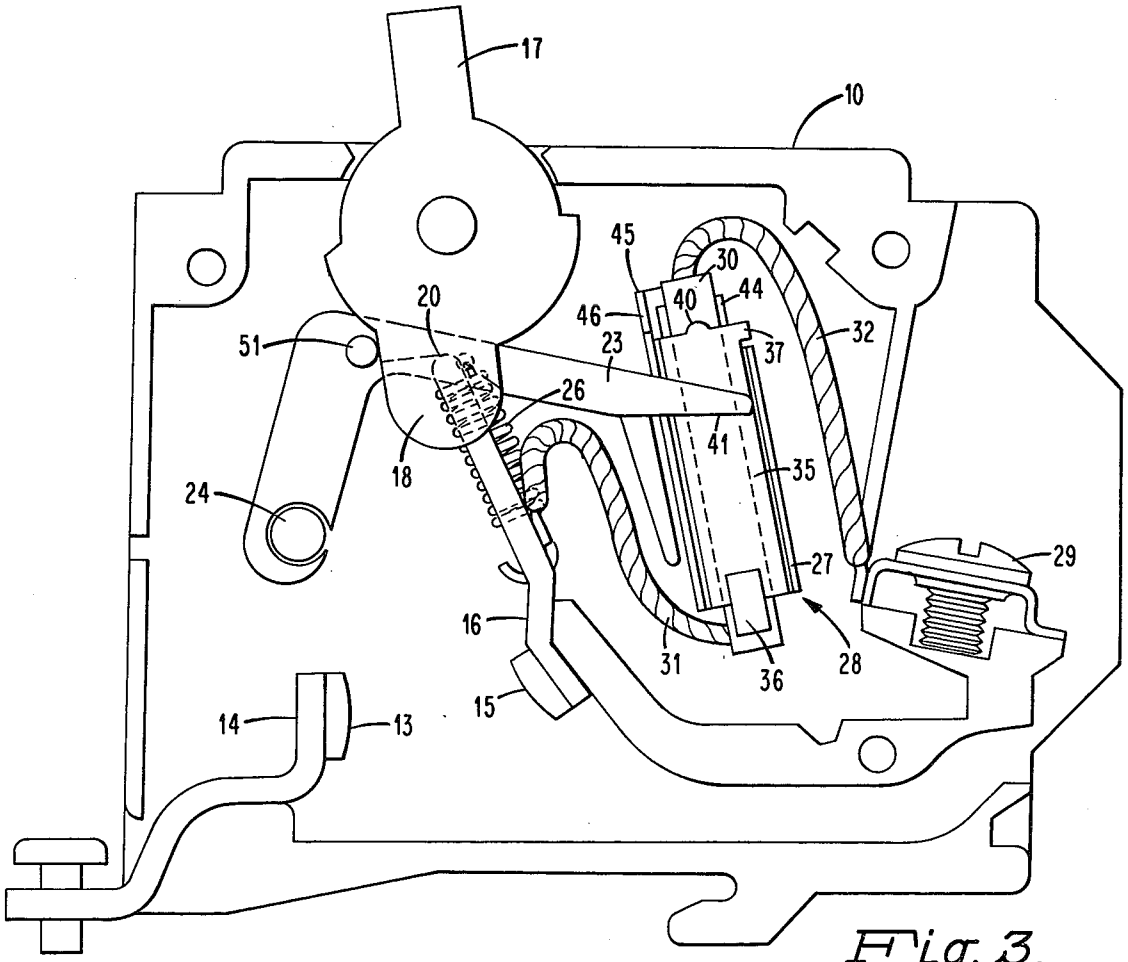
FIG. 3 is a side elevational view of the circuit breaker of FIG. 1 with the cover of the housing removed and showing the contacts in the tripped position.

The end of the contact carrier 16 is positioned in slots in two arms 18 extending from the handle 17 so as to provide a pivot point of connection 20 between the contact carrier 16 and the handle 17. A trip arm 23 is mounted on a boss 24 in the case 10 for pivoting between a set position as shown in FIG. 1 and a tripped position as shown in FIG. 3. An overcenter tension spring 26 has one end connected to the contact carrier 16 and the other end connected to the trip arm 23. The handle 17, contact carrier 16, and spring 26 form an overcenter arrangement, or toggle, which urges the movable contact 15 toward the fixed contact 13 when the spring 26 is on one side of the pivot point 20 as shown in FIG. 1, and urges the movable contact 15 to the open position when the spring 26 is on the other side of the pivot point 20.

A load terminal 29 for connecting the circuit breaker to a load circuit is positioned in the molded case 10. The circuit breaker also contains an overload mechanism 28 including a support member 27 fixed in the case 10. The support member 27 is a rigid member of generally U-shaped horizontal cross-section and may be of magnetic material so as to function as a pole piece as will be explained hereinbelow. A thermally responsive latching member which includes a thermally responsive element 30 and an armature element 35 is mounted in the support member 27. The thermally responsive element 30 is a generally flat elongated bimetallic or thermostat element which is connected in series between the movable contact 15 and the load terminal 29 by flexible conductors 31 and 32, respectively. Flexible conductor 31 is connected between the contact carrier 16 and the lower end, as shown in the figures, of the bimetallic element 30, and flexible conductor 32 is connected between the upper end of the bimetallic element 30 and the load terminal 29. The lower end of the bimetallic element 30 is rigidly fastened to the lower end of the support member 27. The upper end of the bimetallic element 30 is free to move as the element bends due to heating caused by current flow therethrough.

The armature element 35 of the thermally responsive latching member is an elongated member of magnetic material extending generally along the direction of the elongated bimetallic element 30. The lower end of the armature element 35 is pivotally mounted to the lower end of the bimetallic element 30 by means of a leaf spring 36. A hook portion 37 at the upper end of the armature element 35 entraps the upper portion of the bimetallic element 30 while permitting limited motion therebetween. The leaf spring 36 produces a slight bias urging the upper end of the armature element 35 away from the upper end of the bimetallic element 30 whereby the hook portion 37 determines the spacing between the upper end of the armature element 35 and the bimetallic element 30. Insulation 44 attached to the hook portion 37 prevents electrical contact between the upper portions of the armature element and the bimetallic element so that the armature element does not bypass any current around the bimetallic element.

The upper end of the armature element 35 has an edge surface 40 which serves as a latching surface for engaging the trip arm 23. The lower edge surface 41 adjacent to the end of the trip arm 23 provides a latching surface which engages the latching surface 40 of the armature element. As shown the latching surface 40 of the armature element may be provided by a rounded projection extending above the remainder of the upper edge surface to minimize friction between the latching surfaces.

The support member 27 includes a projection 45 at the upper end of one arm which extends toward the trip arm 23 in a direction generally transverse to the trip arm. The outer edge surface 46 of the projection 45 serves as a reference surface against which the end portion of the trip arm abuts. The reference surface 46 is closely adjacent to the latching surface 40 of the armature element 35 and the spacing, in a horizontal direction, from the reference surface 46 to the outer edge of the latching surface 40 determines the amount of overlap of the latching surfaces 40 and 41 of the armature element and trip arm.

The trip arm 23 is urged sideways toward the reference surface 46 by a suitable biasing arrangement. This arrangement may be provided by disposing the center line of the overcenter spring 26 at a slight angle with respect to the plane of movement of the trip arm 23 in its path of movement from the set to the tripped position. Thus, there is a small component of force from the overcenter spring 26 urging the trip arm 23 sideways into contact with the reference surface 46 as best seen in FIG. 2.

With the circuit breaker mechanism in the condition as illustrated in FIGS. 1 and 2 the trip arm 23 is in the set position and manual operation of the handle 17 selectively opens or closes the contacts. In response to an overload current the bimetallic element 30 bends or deflects because of the heat generated therein by the current flow therethrough. Since the lower end of the bimetallic element is fixed in position with respect to the support member 27, the upper end deflects away from the trip arm 23 in a direction generally transverse to the plane of the trip arm; to the right as seen in FIG. 2. Movement of the upper end portion of the bimetallic element 30 moves the hook portion 37 with it causing the armature element 35 to pivot in a clockwise direction about the leaf spring 36 at its lower end. When the deflection of the bimetallic element 30 rotates the armature element 35 through a sufficient angle, the latching surface 40 of the armature element 35 clears the latching surface 40 of the trip arm 23. The amount of movement required depends upon the amount of overlap of the latching surfaces 40 and 41 as determined by the position of the reference surface 46 with respect to the outer edge of the latching surface 40 of the armature element.

When the latching surface 40 disengages from the latching surface 41, the overcenter spring 26 causes the trip arm 23 to pivot in a clockwise direction about the pivot point 24 to the tripped position as shown in FIG. 3. As the trip arm 23 rotates to the tripped position, the line of action of the overcenter spring 26 is shifted to the opposite side of the pivot point 20 of the handle 17 and the contact carrier 16. The overcenter spring 26 causes the contact carrier 16 to pivot in a counterclockwise direction separating the movable contact 15 from the fixed contact 13. The circuit breaker is thus tripped with the elements in the positions as shown in FIG. 3.

The mechanism operates in the typical well known manner to reset the circuit breaker after the overload condition has been cleared. The circuit breaker is manually reset by rotating the handle 17 to the open or extreme clockwise position. During this movement an arm 18 of the handle 17 engages a pin 51 on the trip arm 23 rotating the trip arm in the counterclockwise direction about the pivot point 24. During this rotation the end of the trip arm 23 slides along the surface of the armature element 35 forcing the armature element in a clockwise direction as seen in FIG. 2 against the bias of the leaf spring 36. When the latching surface 41 at the end of the trip arm 23 reaches the latching surface 40 at the upper edge of the armature element 35, the leaf spring 36 biases the armature element into position so that the latching surfaces 40 and 41 are in engagement. The trip arm 23 is thus restored to the set position with the overcenter spring 26 producing a component of force transverse to the path of movement of the trip arm from the tripped to the set position urging the trip arm 23 sideways against the reference surface 46 of the support member 27. During the resetting procedure the contact carrier 16 is restored to the normal open position. The contacts may then be closed by rotating the handle 17 manually in a counterclockwise direction in accordance with normal operation.

The circuit breaker as shown may respond to large overload currents such as under short circuit conditions to trip without any delay. Heavy current flow in the bimetallic element 30 produces a magnetic field which attracts the magnetic armature element 35. The support member 27 functions as a pole piece to augment the magnetic field which is produced. The armature element 35 pivots in a clockwise direction about the leaf spring 36 moving the latching surface 40 at the upper end of the armature element out of engagement with the latching surface 40 at the lower edge of the trip arm 23. When the latching surface 40 is withdrawn from the latching surface 41, tripping of the mechanism occurs in the manner previously described.

In the circuit breaker as shown the reference surface 46 in the arm of the support member 27 and the outer edge of the latching surface 40 of the armature element 35 establish the extent of engagement of the latching surfaces 40 and 41. During assembly of the breaker the amount of overlap of the latching surfaces 40 and 41, and hence the current-time relationship required for tripping, can be adjusted in various ways. The bimetallic element 30 may be bent at its point of attachment to the lower end of the support member 27 to shift the upper end of the bimetallic element 30 and consequently the latching surface 40 of the armature element 35 to the right or left with respect to the reference surface 46, as seen in FIG. 2. Alternatively, the location of the reference surface 46 with respect to the outer edge of the latching surface 40 of the armature element 35 may be adjusted by shifting the reference surface slightly to the right or left as seen in FIG. 2. As illustrated in FIG. 2 a notch 55 may be provided in the projection 45 adjacent to the reference surface 46 to facilitate deforming the projection sufficiently to shift the location of the reference surface 46. Also, since the thickness of the insulation 44 is a factor in determining the location of the outer edge of the latching surface 40 from the reference surface 46, some variation can be obtained by selecting insulation 44 of appropriate thickness.

In the circuit breaker as shown the relationships between the latching surfaces of the overload mechanism and the trip arm are relatively uncomplicated. The bimetallic element 30 is attached to a single rigid component, the support member 27, which includes a reference surface 46 for the trip arm 23 in close proximity to the deflecting end of the bimetallic element 30 and consequently to the latching surface 40 of the armature element 35. Since the reference surface 46 is close to the point of engagement of the latching surfaces 40 and 41, the latching engagement dimension varies little as components change dimensions due to thermal or outside mechanical distortions imposed on the mechanism. Thus, the operating characteristics of circuit breakers in accordance with the invention exhibit an inherent stability despite variations in temperature and mechanical stress over the life of the breaker.

While there has been shown and described what is considered a preferred embodiment of the present invention, it will be obvious to those skilled in the art that various changes and modifications may be made therein without departing from the invention as defined by the appended claims.

What is claimed is:

1. A circuit breaker comprising a housing of insulating material;

a fixed contact mounted in said housing;

a contact carrier with a movable contact thereon;

operating means for manually moving said contact carrier to selectively move said movable contact between a closed position and an open position with respect to said fixed contact;

a trip arm pivotally mounted in said housing and movable from a set position to a tripped position;

a load terminal;

a thermally responsive latching member connected in circuit between said load terminal and said movable contact;

a support member mounted in said housing;

a thermally responsive latching member connected in circuit between said load terminal and said movable contact;

a support member mounted in said housing;

one end of said thermally responsive latching member being fixed to one end of said support member;

said thermally responsive latching member having a latching surface adjacent to the other end thereof engaging said trip arm and maintaining said trip arm in the set position;

said support member having a reference surface adjacent to the other end thereof; and biasing means urging said trip arm against said reference surface when said trip arm is in the set position engaging said latching surface;

said thermally responsive latching member bending in response to a predetermined current condition to move the latching surface adjacent to the other end thereof and disengage said latching surface from said trip arm releasing said trip arm for movement to the tripped position;

movement of the trip arm to the tripped position causing said contacts to open;

wherein said thermally responsive latching member includes an elongated thermally responsive element having one end fixed to said one end of said support member; and an armature element disposed generally along the direction of the elongated thermally responsive element having one end mounted at the one end of said thermally responsive element and including confining means adjacent to the other end thereof for constraining said other end with respect to the other end of the elongated thermally responsive element;

said latching surface of said thermally responsive latching member being located at said other end of the armature element.

2. A circuit breaker in accordance with claim 1 wherein said trip arm has an edge surface adjacent to one end thereof forming a latching surface of the trip arm which is urged against the latching surface of the armature element by said overcenter spring when the trip arm is in the set position;

said biasing means urges said one end of the trip arm in a direction generally transverse to the path of movement of the trip arm from the set to the tripped position to bear against said reference surface when said trip arm is in the set position with the latching surface of the trip arm engaging the latching surface of the armature element; and said elongated thermally responsive element bends in a direction generally transverse to the path of movement of the trip arm and away from the trip arm in response to said predetermined current condition to pivot the armature element about the one end thereof removing said latching surface of the armature element from engagement with the latching surface of the trip arm thereby releasing the trip arm from the set position for movement to the tripped position.

3. A circuit breaker in accordance with claim 1 wherein said one end of the armature element is pivotally mounted at said one end of the thermally responsive element;

said confining means adjacent to said other end of the armature element includes a hook portion of said armature element entrapping said other end of the thermally responsive element to permit limited movement between said other end of the armature element and said other end of the thermally responsive element;

said armature element is of magnetic material; and said armature element is attracted toward said thermally responsive element in response to heavy current flow through the thermally responsive element to pivot the armature element about said one end thereof removing the latching surface of the armature element from engagement with the latching surface of the trip arm thereby releasing the trip arm from the set position for movement to the tripped position.

4. A circuit breaker in accordance with claim 3 wherein said support member includes a projection adjacent to said other end thereof extending toward said trip arm in a plane generally transverse to the path of movement of the trip arm; and said projection has an edge surface forming said reference surface.

5. A circuit breaker comprising a housing of insulating material;

a fixed contact mounted in said housing;

a manually movable handle mounted in said housing;

a contact carrier with a movable contact thereon and pivotally engaging said handle at a pivot point;

a trip arm pivotally mounted in said housing;

an overcenter spring connected between said contact carrier and said trip arm urging said contact carrier against said handle;

said handle, contact carrier, and overcenter spring forming an overcenter arrangement for closing said contacts when the spring is on one side of said pivot point and opening said contacts when the spring is on the other side of said pivot point;

a load terminal mounted in said housing;

a thermally responsive latching member connected in circuit between said load terminal and said movable contact;

a support member mounted in said housing;

one end of said thermally responsive latching member being fixed to one end of said support member;

said thermally responsive latching member having a latching surface adjacent to the other end thereof engaging said trip arm and maintaining said trip arm in the set position;

said support member having a reference surface adjacent to the other end thereof; and biasing means urging said trip arm against said reference surface when said trip arm is in the set position engaging said latching surface;

said thermally responsive latching member bending in response to a predetermined current condition to move the latching surface adjacent to the other end thereof and disengage said latching surface from said trip arm releasing said trip arm for movement to the tripped position;

movement of the trip arm to the tripped position moving the overcenter spring to the other side of said pivot point causing said contacts to open;

wherein said thermally responsive latching member includes an elongated thermally responsive element having one end fixed to said one end of said support member; and an armature element disposed generally along the direction of the elongated thermally responsive element having one end mounted at the one end of said thermally responsive element and including confining means adjacent to the other end thereof for constraining said other end with respect to the other end of the elongated thermally responsive element;

said latching surface of said thermally responsive latching member being located at said other end of the armature element.

6. A circuit breaker in accordance with claim 5 wherein said trip arm has an edge surface adjacent to one end thereof forming a latching surface of the trip arm which is urged against the latching surface of the armature element by said overcenter spring when the trip arm is in the set position;

said biasing means urges said one end of the trip arm in a direction generally transverse to the path of movement of the trip arm from the set to the tripped position to bear against said reference surface when said trip arm is in the set position with the latching surface of the trip arm engaging the latching surface of the armature element; and said elongated thermally responsive element bends in a direction generally transverse to the path of movement of the trip arm and away from the trip arm in response to said predetermined current condition to pivot the armature element about the one end thereof removing said latching surface of the armature element from engagement with the latching surface of the trip arm thereby releasing the trip arm from the set position for movement to the tripped position.

7. circuit breaker in accordance with claim 6 wherein said one end of the armature element is pivotally mounted at said one end of the thermally responsive element;

said confining means adjacent to said other end of the armature element includes a hook portion of said armature element entrapping said other end of the thermally responsive element to permit limited movement between said other end of the armature element and said other end of the thermally responsive element;

said armature element is of magnetic material; and said armature element is attracted toward said thermally responsive element in response to heavy current flow through the thermally responsive element to pivot the armature element about said one end thereof removing the latching surface of the armature element from engagement with the latching surface of the trip arm thereby releasing the trip arm from the set position for movement to the tripped position.

8. A circuit breaker in accordance with claim 7 wherein said support member includes a projection adjacent to said other end thereof extending toward said trip arm in a plane generally transverse to the path of movement of the trip arm; and said projection has an edge surface forming said reference surface.

9. A circuit breaker in accordance with claim 8 wherein said projection of said support member has a notch therein adjacent to said edge surface for permitting deforming of said projection to adjust the position of said edge surface which forms said reference surface and thereby adjust the extent of engagement of the latching surfaces of the trip arm and armature element.

10. A circuit breaker in accordance with claim 8 wherein said overcenter spring is disposed at an angle with respect to the plane of the path of movement of the trip arm from the set to the tripped position to produce a component of force urging said one end of the trip arm against said reference surface.

* * * * *